US007516514B2

(12) United States Patent
Rieder

(10) Patent No.: US 7,516,514 B2
(45) Date of Patent: Apr. 14, 2009

(54) DOOR STOPPER FOR A MOTOR VEHICLE DOOR AND MOTOR VEHICLE DOOR FOR A MOTOR VEHICLE WITH A DOOR STOPPER OF THIS TYPE

(75) Inventor: Klaus Rieder, Weissach-Flacht (DE)

(73) Assignee: Dr. Ing. H.C.F. Porsche Aktiengesellschaft, Stuttgart (DE)

( * ) Notice: Subject to any disclaimer, the term of this patent is extended or adjusted under 35 U.S.C. 154(b) by 337 days.

(21) Appl. No.: 11/312,955

(22) Filed: Dec. 21, 2005

(65) Prior Publication Data

US 2006/0130274 A1 Jun. 22, 2006

(30) Foreign Application Priority Data

Dec. 22, 2004 (DE) ..... 10 2004 061 787

(51) Int. Cl.
*E05F 5/02* (2006.01)

(52) U.S. Cl. ..... 16/82; 16/86 C; 16/288; 16/370

(58) Field of Classification Search ..... 16/82, 16/86 C, 84, 311, 365, 286
See application file for complete search history.

(56) References Cited

U.S. PATENT DOCUMENTS 1,483,316 A * 2/1924 Seelinger ..... 16/82
1,696,936 A * 1/1929 Breneman ..... 49/400
2,005,457 A * 6/1935 Dubitsky et al. ..... 16/51
2,043,976 A * 6/1936 Schonitzer ..... 16/86 C
2,104,124 A * 1/1938 Haberstump ..... 16/85
2,176,641 A * 10/1939 Schonitzer ..... 16/86 C
2,184,201 A * 12/1939 Schonitzer ..... 16/86 C
3,006,683 A * 10/1961 Smith ..... 49/248
3,584,331 A * 6/1971 D'Hooge ..... 16/82
3,658,808 A 4/1972 Kinstler (Continued)

FOREIGN PATENT DOCUMENTS

DE 1900133 9/1969

(Continued)

OTHER PUBLICATIONS

European Search Report dated Oct. 17, 2006 with partial English translation (Five (5) pages).

(Continued)

*Primary Examiner*—Victor Batson
*Assistant Examiner*—Roberta Delisle
(74) *Attorney, Agent, or Firm*—RatnerPrestia

(57) ABSTRACT

A door stopper for a motor vehicle door has a piston-cylinder unit arranged basically longitudinally inside the motor vehicle door. The unit is connected in a swiveling manner at a first end with the motor vehicle door and is able to interact at a second end with a stationary structural section of the motor vehicle. In order to ensure that the door stopper requires only a small installation space, the door stopper includes a multi-part lever mechanism, which transforms a swiveling motion of the motor vehicle door chiefly into a back and forth thrusting motion, upon door opening or closing, on the piston-cylinder unit. A first lever of the lever mechanism can be guided out of the motor vehicle door and can be connected with the stationary structural section on a first swiveling axis.

7 Claims, 2 Drawing Sheets

U.S. PATENT DOCUMENTS

| | | | | | |
|---|---|---|---|---|---|
| 3,888,044 | A * | 6/1975 | Lystad | 49/227 |
| 3,979,790 | A * | 9/1976 | Chiarappa | 16/84 |
| 4,685,722 | A * | 8/1987 | Srock | 296/146.6 |
| 4,689,849 | A * | 9/1987 | Eger et al. | 16/82 |
| 4,797,971 | A * | 1/1989 | Eger et al. | 16/82 |
| 5,337,519 | A * | 8/1994 | Bergesio | 49/351 |
| 5,586,361 | A * | 12/1996 | T olle et al. | 16/51 |
| 5,836,050 | A * | 11/1998 | Rumez et al. | 16/84 |
| 6,564,425 | B2 * | 5/2003 | Audisio | 16/86 B |
| 6,594,858 | B1 * | 7/2003 | Kremer | 16/332 |
| 6,728,993 | B1 * | 5/2004 | Murayama | 16/342 |
| 2004/0111832 | A1 * | 6/2004 | Murayama et al. | 16/82 |

FOREIGN PATENT DOCUMENTS

| | | | |
|---|---|---|---|
| DE | 35 19 203 | A1 | 7/1986 |
| DE | 3642442 | | 8/1987 |
| DE | 92 01 226.4 | | 3/1992 |
| DE | 44 00 784 | C1 | 4/1995 |
| EP | 0 978 615 | A2 | 2/2000 |
| GB | 2312469 | | 10/1997 |
| WO | WO 93/06326 | | 4/1993 |

OTHER PUBLICATIONS

German Office Action dated Dec. 13, 2005, with English translation.

* cited by examiner

DOOR STOPPER FOR A MOTOR VEHICLE DOOR AND MOTOR VEHICLE DOOR FOR A MOTOR VEHICLE WITH A DOOR STOPPER OF THIS TYPE

This application claims the priority of German application 10 2004 061 787.2, filed Dec. 22, 2004, the entire disclosure of which is incorporated by reference.

BACKGROUND AND SUMMARY OF THE INVENTION

This invention concerns a door stopper for a motor vehicle door having a piston-cylinder unit which can be arranged substantially longitudinally inside the motor vehicle door, can be connected in a swiveling manner at a first end with the motor vehicle door, and can interact at a second end on a stationary structural section of a structure of the motor vehicle, as well as a motor vehicle door with a door stopper of this type.

Door stoppers with piston-cylinder units for motor vehicle doors are known from German Patent document 44 00 784 C1 and German Patent document 35 19 203 A1, for example. According to the latter document, a door stopper is arranged in a stationary structural section, such as a door column, of the motor vehicle. German Patent document DE 44 00 784 C1 describes providing an infinitely variable door stopper apparatus so that a motor vehicle door can be held in any desired open position. The door stopper includes a piston-cylinder unit for this purpose, in which the piston within the cylinder can be blocked in any position. The piston-cylinder unit is arranged inside the door body of the motor vehicle door and thereby pivoted with a first end on the motor vehicle door. The other end of the piston-cylinder unit projects out of the door body in the region of the door rabbet and is connected so as to interact with a stationary structural section, namely a door column. The cylinder is swiveled with the door, and the piston rod, projecting out of the cylinder, is swiveled with the door column. When opening or closing the door, the piston is moved inside the cylinder and, in this way, the piston rod is displaced more or less out of the cylinder. In addition to extension by drawing out the piston rod, the piston-cylinder unit is subjected to a swiveling motion when the motor vehicle door is moved, and thus opened or closed. The recess in the door rabbet penetrated by the piston rod is constructed with corresponding breadth so that swiveling of the piston-cylinder unit is not impeded.

An object of the invention is to provide a door stopper, or a motor vehicle door including a door stopper, which requires reduced construction space inside the motor vehicle door.

This object is achieved by way of a door stopper or a motor vehicle door including a door stopper having a multi-part lever mechanism, which converts a swiveling motion of the motor vehicle door during opening or closing on the piston-cylinder unit chiefly into a back and forth thrusting motion. At least a first lever of the lever mechanism can be guided out of the motor vehicle door and connected with the stationary structural section on a first swiveling axis. Further features of the invention are defined by the claims.

Advantages attained with the invention can be seen when the motor vehicle door moves. The piston-cylinder unit in this case requires a reduced swiveling region, since, in accordance with the invention, the multi-part lever mechanism is arranged between the piston-cylinder unit and the stationary structural section. The mechanism basically transforms the swiveling motion of the motor vehicle door upon opening or closing into a back and forth thrusting motion. A certain swiveling of the piston-cylinder thus can be present, but the back and forth thrusting motion represents the main motion. In this way, the piston of the piston-cylinder unit can be moved without the entire piston-cylinder unit needing an associated swiveling area. This results advantageously in an almost arbitrary installation site with reduced construction space of the door stopper inside the motor vehicle door, especially since further units, such as window lifts, air bag devices, loud speakers, or other installations, are to be accommodated in motor vehicle doors of this type.

In accordance with certain features of the door stopper, the piston-cylinder unit is continuously blockable so that the motor vehicle door can be held in almost any open position.

The multi-part lever mechanism is preferably a crank mechanism in one configuration of the invention. Crank mechanisms of this type are inexpensive and, in addition, relatively immune to disturbance, so that a long service life can be expected.

According to one embodiment, the piston-cylinder unit is a member of a multi-part lever mechanism, such as the piston rod of the crank mechanism.

An especially simple crank mechanism has merely a linkage, a crank, and the thrust rod. The linkage of the crank mechanism, moreover, can produce the connection with the stationary structural section.

An especially advantageous further development of the invention is one in which the crank mechanism supplies a lever reduction in addition to transforming the swiveling motion of the door into back and forth thrusting motion, with the lever reduction leading to a diminished blocking force inside the piston-cylinder unit. A correspondingly economical design of the piston-cylinder unit is consequently possible. The gear ratio of the lever reduction can be altered as a function of the distance the second swiveling axis is arranged in relation to the third or fourth swiveling axis.

Due to the fact that the piston-cylinder unit requires only a small swiveling range when the motor vehicle doors are moving, the door stopper of the invention can also be used in motor vehicle doors which are outfitted with a door window which can be lowered. If the door window is lowered, the space available inside the door body is significantly reduced. With the door stopper of the invention, however, a door stopper having the piston-cylinder unit can also be used easily for such motor vehicle doors.

In one especially preferred embodiment, the piston-cylinder unit is arranged between exterior skin of the door body and a lowering plane of the door window. Consequently, sufficient space remains inside the door body for other elements. Moreover, the piston-cylinder unit can be arranged at almost any desired height inside the door body and need not necessarily be arranged in the lower region of the door body, which is not tangent to the lowered door window.

In another especially preferred embodiment, the piston-cylinder unit is arranged in a swiveling manner on a safety reinforcement of the door body. The safety reinforcement usually consists of a support extending in a longitudinal direction of the motor vehicle door, which is intended to protect the motor vehicle occupants, especially in the event of a side impact.

According to yet another especially preferred embodiment, the piston-cylinder unit is arranged between the upper and lower hinge elements with respect to the height of the vehicle door, resulting in an optimized introduction of force into the lever mechanism or into the piston-cylinder unit.

The invention will be explained in greater detail below with reference to the drawings.

DETAILED DESCRIPTION OF THE INVENTION

Figure 1:
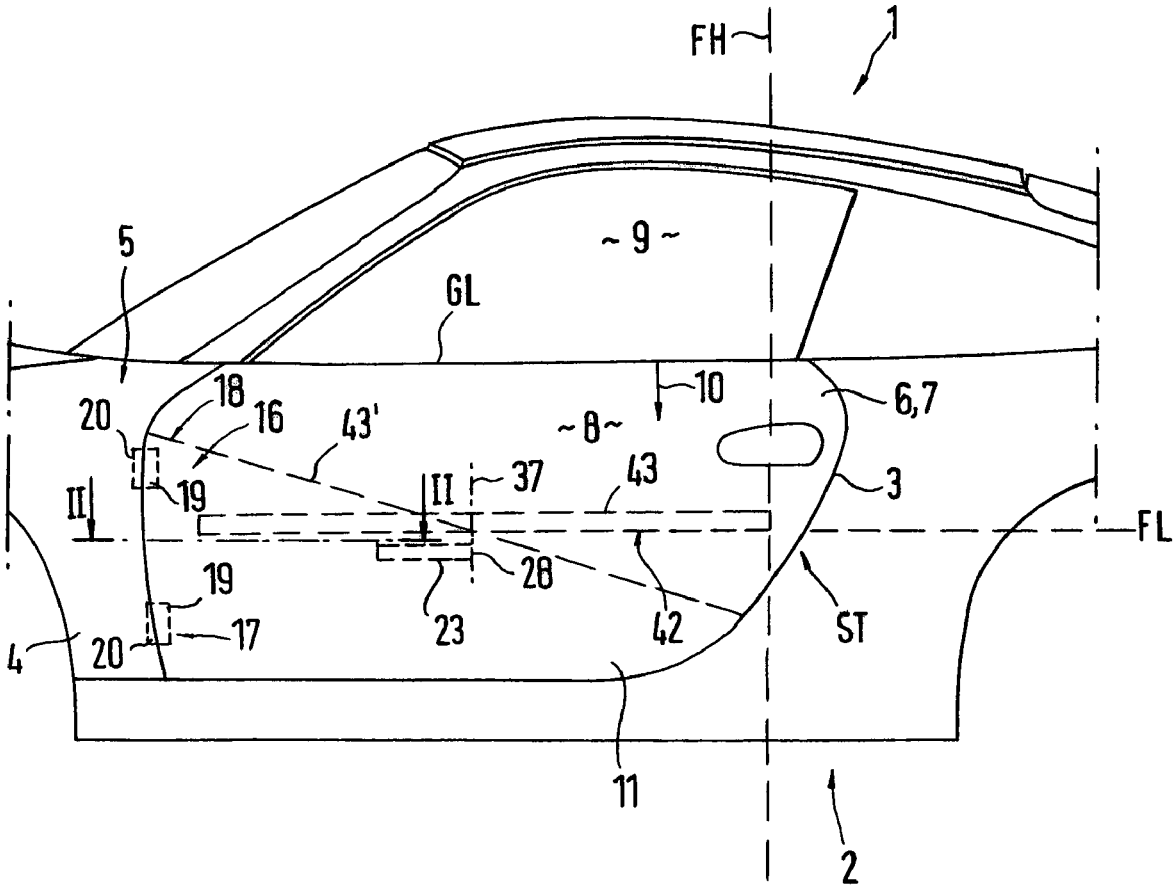
FIG. 1 illustrates a sectional side view of a motor vehicle with a motor vehicle door.
Figure 2:
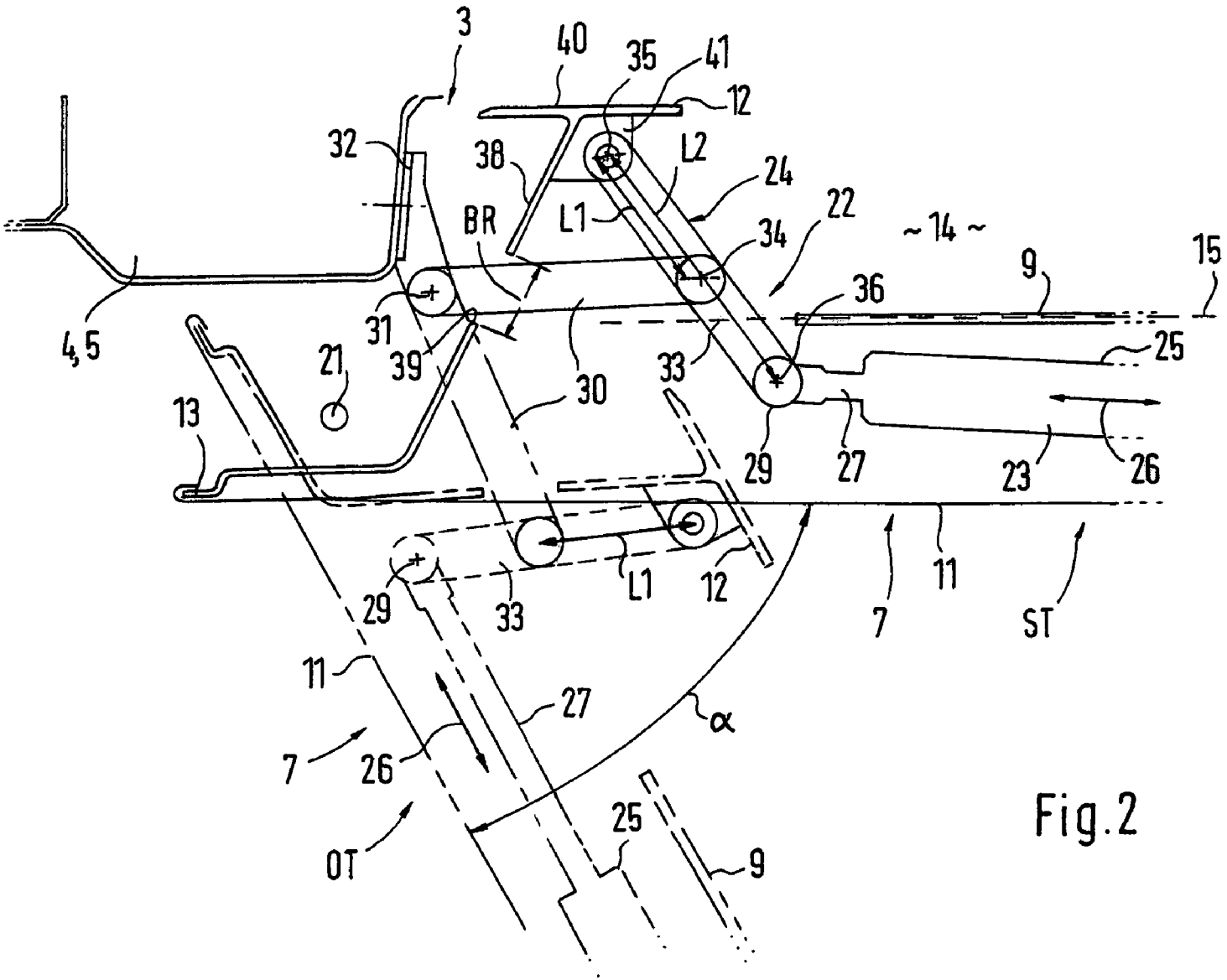
FIG. 2 illustrates a section through the motor vehicle door along line II-II in FIG. 1.

FIG. 1 partially shows a motor vehicle 1, which has a structure 2 with an automobile body cutout 3. The structure 2 includes, in addition to a stationary section 4 with a door column 5, such as an A-column, a mobile section 6, which, as illustrated, is formed by a motor vehicle door 7. The motor vehicle door 7 comprises a door body 8 and a door window 9 which can be lowered into the door body 8. The door window is illustrated in FIG. 1 in a closed position above the belt line GL. The window can be displaced at least partially into the door body 8 downward in arrow direction 10 beneath the beltline GL in a not represented open position. The door body 8 comprises an external skin 11 (see also FIG. 2) and a frame-like interior door element 12 that is connected to the exterior skin 11 with a connection flange 13. The outer skin 11 and the interior door element 12 enclose a door shaft 14 inside the door body 8 into which the door window 9 can be depressed in a plane 15 (FIG. 2).

The motor vehicle door 7 is pivoted on the stationary structural section 4, especially the door column 5, here the A column, by means of a hinge device 16. The hinge device 16—viewed in a direction of the motor vehicle vertical axis FH—can include hinges 17 and 18 arranged one above the other. Each hinge possesses a door-side hinge element 19 as well as a structural side hinge element 20, which can, for example, be respectively connected with each other through a hinge pin (not illustrated), with the hinge pin forming the swiveling axis 21 (FIG. 2) of the motor vehicle door 7. The motor vehicle door can be swiveled about this swiveling axis 21 from a closed position ST depicted in FIG. 1 into an open position OT, which open position OT is represented in dotted lines in FIG. 2. A swiveling range with a swiveling angle $\alpha$ lies between the closed position ST and the open position OT of the motor vehicle door, which can amount to 60°, for example. The motor vehicle door 7 can be fixed in almost any desired swiveling angle $\alpha$ between the closed position ST and the open position OT. A door stopper 22 is provided for this in accordance with FIG. 2. The door stopper includes a piston-cylinder unit 23 extending in the longitudinal direction of door 7, thus in the longitudinal direction of the motor vehicle FL, as well as a multi-part lever mechanism 24. The piston-cylinder unit, hereinafter designated simply as unit 23, includes a cylinder 25 in which a piston (not represented here) can be guided so as to be longitudinally displaceable (arrow direction 26). A piston rod 27 projecting from the cylinder 25 is connected with the piston. The unit 23 hence includes a first end 28 and a second end 29, whereby preferably the first end 28 is on the free end of the cylinder 25 and the second end 29 is on the end of the piston rod 27. Depending on the orientation of the arrangement of the unit 23, the end 28 or 29 is connected in a swiveling manner with the motor vehicle door 7, which will be addressed in greater detail further below. Correspondingly, the other end 29 or 28 of the unit 23 is associated with the stationary structural section 4, such as the door column 5. In order to be able to hold the motor vehicle door 7 in any desired swiveling angle $\alpha$, the piston (not represented here) is constructed blockable inside the cylinder 25, i.e. the piston can be fixed in position continuously in any desired extension position along arrow direction 26. Such units 23 are nonetheless known in the state of the art so that they will not be addressed further.

The multi-part lever mechanism 24 is provided in order to convert the swiveling motion of the motor vehicle door 7 about the swiveling axis 21 into a back and forth thrusting motion for the unit 23 so that the piston rod 27 is moveable in the direction of the arrow 26. For this, the lever mechanism 24 is on the one hand connected with the piston rod 27 and on the other with the stationary structural section 4. At least a first lever 30 of the lever mechanism 24 is guided out of the door body 8 and is pivoted on the stationary structural section 4 on a first swiveling axis. The first swiveling axis 31 is borne by a structure-side connection 32, which is fastened on the section 4. The lever mechanism 24 possesses a second lever 33 arranged inside the door body 8, the lever being connected with the first lever 30 on a second swivel axis 34. The second lever 33 is held on the door body, especially the internal door element 12, through a third swiveling axis 35. The piston rod 27 is fastened on the second lever 33 with its end 29 in a fourth swiveling axis 36. The lever mechanism 24 is moreover so configured or constructed that it forms a crank mechanism with a first lever 30 which forms a linkage, a second lever 33 which forms a crank, and the piston rod 27 as a piston rod. The second swiveling axis 34 is on the second lever 33 between the third swiveling axis 35 and the fourth swiveling axis 36. Consequently a first effective lever length L1 exists between the second and third swiveling axes 34 and 35 and a second lever length L2 exists between the third and fourth swiveling axes 35 and 36, owing to which the lever mechanism 24 furnishes a lever gear reduction, in addition to converting the swiveling motion of the motor vehicle door 7 into the back and forth thrusting motion (arrow direction 26), in order to be able to reduce the blocking forces to be accommodated by the unit 23. The unit 23 is connected with the motor vehicle door 7 about a fifth swiveling axis, as is apparent from FIG. 1. The fifth swiveling axis 37 can also be constructed as a universal joint.

The door stopper 22 is arranged inside the motor vehicle door 7 as follows. The unit 23 extends in the longitudinal direction of the motor vehicle FL and is located between the plane 15 and the outer skin 11 and points with its end 29 in the direction of a door rabbet 38, which is formed by a segment of the interior door element 12. The door rabbet 38 has, preferably in the middle, a recess 39 through which the first lever 30 of the lever mechanism 24 passes. A console 41 is constructed on an interior segment 40 of the interior door element 12 if need be running parallel to the outer skin 11, the console carrying the third swiveling axle 35. The second lever 33 consequently forms the lever length L2, which extends from the console 41 or the third swiveling axis 35 up to the unit 23 intersecting with the plane 15. The arrangement of the door stopper 22 along the height of the motor vehicle door 7, thus measured along the motor vehicle vertical axis FH, can take place between the two door-side hinge elements 19, if need be somewhat centrally, which is apparent from FIG. 1. For this, the unit 23 can be pivoted with its end 28 in the swiveling axis 37 borne by a safety reinforcement 42 running in the motor vehicle longitudinal direction FL. The safety reinforcement 42 comprises a lateral impact support 43, which extends along the longitudinal extension of the motor vehicle FL inside the door body 8. The side impact support 43 can alternatively run obliquely, i.e. at an angle in relation to the longitudinal axis of the motor vehicle FL, which is depicted in FIG. 1 by a side impact support 43' indicated in dotted lines. The unit 23 can be located above or below the side impact support 43.

As already mentioned, the open position OT of the motor vehicle door 7 is represented in dotted lines in FIG. 2. The piston rod 27 is pulled out of the cylinder 25 in relation to its position in the closed position ST of the motor vehicle door 7. The lever mechanism 24 has thus converted the swiveling motion about the swiveling axis 21 of the motor vehicle door 27 into the back and forth thrusting motion along the direction of the arrow 26. When closing the motor vehicle door from the open position OT into the closing position ST, the thrusting motion is obviously inverted, which is indicated by the arrow direction 26 represented as a double arrow. The lever arm length L1 is here chosen such that the first lever 30 basically follows the swiveling motion of the motor vehicle door 7 such that the breadth BR of the recess 39 can only be dimensioned slightly larger than the breadth of the first lever 30.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and the equivalents thereto.

The invention claimed is:

1. A door stopper connected to a motor vehicle door comprising:

a piston-cylinder unit having a thrust rod, which is arranged substantially longitudinally inside the motor vehicle door, is connected in a swiveling manner at a first end with the motor vehicle door, and interacts at a second end on a stationary structural section of a structure of the motor vehicle, and a multi-part lever mechanism, which converts a swiveling motion of the motor vehicle door during opening or closing on the thrust rod of the piston-cylinder unit chiefly into a back and forth thrusting motion, said multi-part lever mechanism having at least a first lever of the lever mechanism guided out of the motor vehicle door and directly connected with the stationary structural section on a first swiveling axis and a second lever forming a crank, wherein the multi-part lever mechanism, said piston cylinder unit form a crank mechanism, wherein the first lever and a second lever of the crank mechanism are directly connected to each other inside the vehicle door on a second swiveling axis, wherein the second lever and the motor vehicle door are directly connected together on a third swiveling axis, wherein the second lever and the thrust rod are directly connected together on a fourth swiveling axis, and wherein the second swiveling axis is between the third and fourth swiveling axes on the second lever.

2. The door stopper according to claim 1, wherein the piston-cylinder unit is continuously blockable.

3. A door stopper according to claim 1, wherein the thrust rod is guided out of the cylinder.

4. A door stopper according to claim 1, comprising a door body on which a door window that can be depressed into the door body in a plane is arranged.

5. A door stopper according to claim 4, wherein the door body includes an exterior skin and the piston-cylinder unit is arranged between the exterior skin and the plane.

6. A door stopper according to claim 1, wherein hinge elements of upper and lower hinges, respectively, are installed on the motor vehicle door, wherein the motor vehicle door is pivotable by way of the hinges on the stationary structural section, and wherein the door stopper is located between the hinge elements inside the door body.

7. A door stopper according to claim 2, wherein the thrust rod is guided out of the cylinder.

* * * * *